US005984574A

United States Patent [19]

Sinclair

[11] Patent Number: 5,984,574

[45] Date of Patent: Nov. 16, 1999

[54] DRIP FIELD MANIFOLD SYSTEM

[76] Inventor: Thomas A. Sinclair, 4386 Lilburn Industrial Way, Lilburn, Ga. 30047

[21] Appl. No.: 08/909,179

[22] Filed: Aug. 11, 1997

[51] Int. Cl.[6] ..... E02B 13/00

[52] U.S. Cl. ..... 405/43; 405/36

[58] Field of Search ..... 405/36, 37, 39, 405/40, 41, 42, 43, 44, 45, 47, 49, 50, 51

[56] References Cited

U.S. PATENT DOCUMENTS

| | | | |
|---|---|---|---|
| 4,090,523 | 5/1978 | Kelly, Jr. et al. . | |
| 4,818,420 | 4/1989 | Mims . | |
| 4,878,781 | 11/1989 | Gregory et al. | 405/51 X |
| 4,971,690 | 11/1990 | Justice | 405/36 X |
| 4,986,905 | 1/1991 | White . | |
| 5,133,622 | 7/1992 | Hewlett | 405/43 X |
| 5,200,065 | 4/1993 | Sinclair et al. . | |
| 5,217,323 | 6/1993 | Bilson | 405/45 X |
| 5,267,655 | 12/1993 | Heino et al. . | |
| 5,269,911 | 12/1993 | Stegall, Sr. et al. . | |
| 5,360,556 | 11/1994 | Ball et al. . | |
| 5,401,397 | 3/1995 | Moorehead . | |
| 5,441,631 | 8/1995 | Stegal, Sr. et al. . | |
| 5,522,672 | 6/1996 | Moore . | |
| 5,597,264 | 1/1997 | Laak | 405/43 X |
| 5,597,477 | 1/1997 | Harry, III . | |

OTHER PUBLICATIONS

"Land Treatment Systems" by Netafim Irrigation, Inc., publication date unknown.

*Primary Examiner*—David Bagnell
*Assistant Examiner*—Frederick L. Lagman
*Attorney, Agent, or Firm*—Hinkle & Associates, P.C.

[57] ABSTRACT

A drip field manifold system comprises an upper manifold, a flush manifold and a plurality of drip lines operatively connected to the upper and flush manifolds. The upper and flush manifolds are disposed vertically above the upper most drip line in a drip field to isolate the drip lines from one another during periods of suspended effluent flow from a waste water treatment system, preventing back flow of effluent through the manifolds to the lower most drip line and resulting over saturation of the drip field.

9 Claims, 4 Drawing Sheets

4
10
12
6
8
14
18
16
32

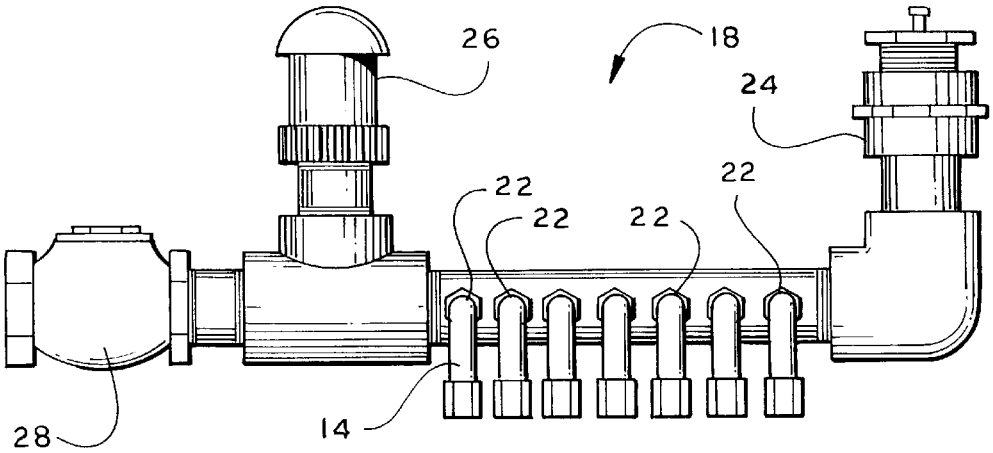
Fig. 5
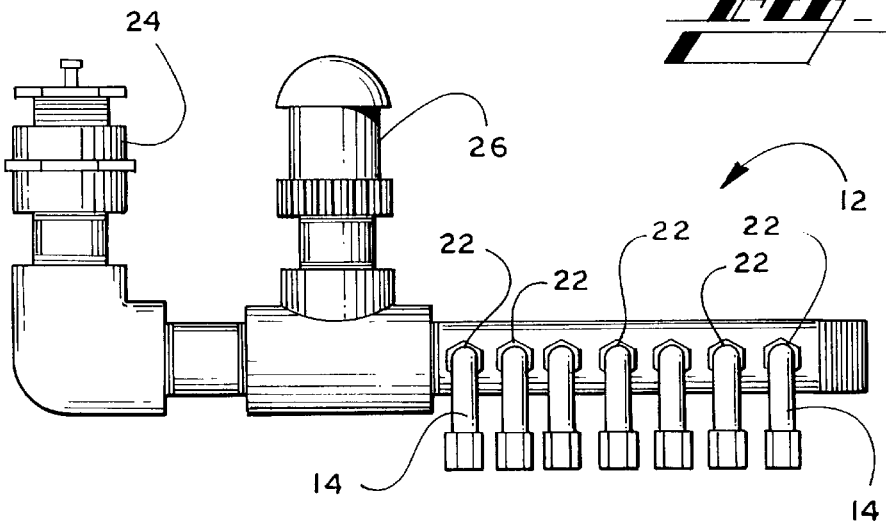
Fig. 4
Fig. 6
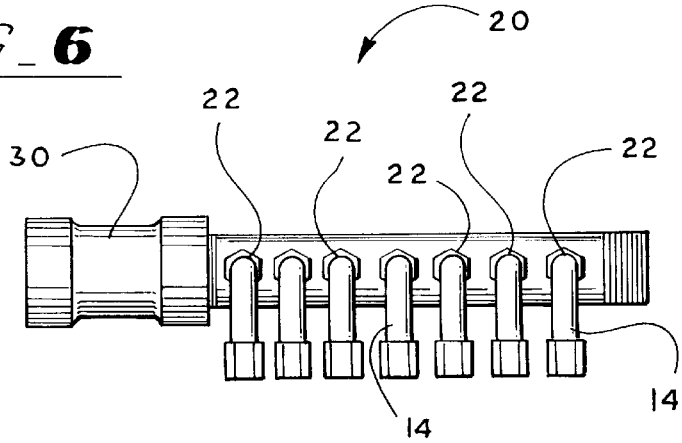

DRIP FIELD MANIFOLD SYSTEM

BACKGROUND OF THE INVENTION

I. Field of the Invention

The present invention relates generally to the field of waste water treatment systems. More particularly, the present invention relates to a drip field manifold system which prevents over saturation of a drip field.

II. Description of the Related Art

Drip fields are commonly utilized with waste water treatment systems for the disposal of effluent into the soil. The) are especially useful with land lots having steep grades, rocky terrain, high water tables or soil with low percolation rate capability. Drip fields generally comprise an inlet and an outlet manifold with a plurality of substantially parallel drip lines connected therebetween acting in concert to discharge the effluent from the given waste water treatment system into the soil. Further, the waste water treatment systems are designed with timers to periodically shut off effluent flow to the drip field to prevent over saturation. To assist in preventing over saturation of a portion of the drip field, the drip lines are typically disposed substantially perpendicular to the slope of the grade and along the contour of a portion of the land lot. The manifolds accordingly are disposed substantially parallel to the slope. A drip line often comprises a pressure-induced, water-emitting drip hose having either above or below ground drip emitters. In another configuration, the drip lines are disposed substantially parallel to the slope of the grade with the inlet manifold being at a higher elevation than the discharge manifold.

Unfortunately, either configuration for the drip field arrangement fails to prevent over saturation, which can result in effluent run-off causing waste water contamination of ground water or local lakes and streams. Even though effluent flow from the waste water treatment system to the drip field is periodically terminated, the effluent remaining in the manifolds and the drip lines continues to flow down grade due to gravity and is discharged at the lower most drip line, commonly through the lower most drip emitters, because the individual drip lines are not isolated from one another. Additionally, previously discharged effluent can be siphoned back into the upper most drip lines and thereby redirected to the lower most drip line and discharged, adding to the over saturation problem. Also, the upper most drip lines can act as drains by receiving previously discharged effluent which back flows through the drip emitters and is redirected to the lower most drip line to be discharged, adding to the over saturation problem as well. Much effort has been expended in the waste water treatment industry to eliminate the problem of over saturation of a portion of the drip field, and until now, without success.

In U.S. Pat. No. 5,200,065, I describe a tertiary waste treatment and disposal system having a drip field. The drip field has an upper manifold, a lower manifold and drip lines extending from the upper manifold to the lower manifold. In this configuration, the drip lines are not isolated from one another and the effluent remaining in the manifolds continue to drain through drip emitters of the drip lines even after the flow of effluent from the waste treatment system is discontinued. Since the manifolds run the length of the drip field, a significant amount of effluent is capable of being retained within the manifolds.

U.S. Pat. No. 5,441,631 issued to Stegall, Sr., et al also describes a waste treatment system having a drip field. As shown in FIGS. 1 and 2 thereof, the drip field has a manifold and drip line configuration similar to the one described in U.S. Pat. No. 5,200,065.

Harry, III, describes a sewage effluent disposal system having sparger in holding tank in U.S. Pat. No. 5,597,477. Referring particularly to FIG. 2 thereof, this system also has a drip field, but the drip lines are in a looped arrangement extended between a discharge manifold and a return manifold. Again, the drip lines are not isolated from one another because the manifolds are perpendicular to the drip lines and extend the length of the drip field, enabling the same problems of over saturation because the upper most drip line is operably connected and drains to the lower most drip line even after effluent flow is suspended from the waste treatment system.

SUMMARY OF THE INVENTION

In accordance with the present invention and the contemplated problems which have and continue to exist in this field, one of the objectives of this invention is to provide a drip field manifold system for use with a waste water treatment system that is improved over the prior art.

It is another object of the present invention to provide a drip field manifold system having drip lines operably isolated from one another.

It is a further object of the present invention to provide a drip field manifold system having an upper manifold spaced vertically above and operably connected to drip lines that are disposed substantially parallel to the inlet manifold.

It is a yet another object of the present invention to provide a drip field manifold system having a flush manifold operably connected to drip lines and spaced vertically above the upper most drip line.

This invention accomplishes the above and other objectives and overcomes the disadvantages of the prior art by providing a drip field manifold system that is simple in design and construction, inexpensive to fabricate, and easy to use. The drip field manifold system comprises an upper manifold, a flush manifold and a plurality of drip lines operatively connected to the upper and flush manifolds. The upper and flush manifolds are disposed vertically above the upper most drip line in a drip field to isolate the drip lines from one another during periods of suspended effluent flows from a waste water treatment system, preventing back flow of effluent through the manifolds to the lower most drip line and resulting over saturation of the drip field. In one embodiment, the manifolds are spaced apart and positioned on either side of the drip field. Another embodiment has the manifolds adjacent one another and positioned on the same side of the drip field.

It is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Other objects, advantages and capabilities of the invention will become apparent from the following description taken in conjunction with the accompanying drawings showing preferred embodiments of the invention.

BRIEF DESCRIPTION OF THE DRAWINGS

The invention will be better understood and the above objects as well as objects other than those set forth above will become apparent when consideration is given to the following detailed description thereof. Such description makes reference to the annexed drawings wherein:

FIG. 4 is an upper manifold made in accordance with the present invention;

FIG. 5 is a flush manifold made in accordance with the present invention; and FIG. 6 is an extension manifold made in accordance with the present invention.

Figure 1:
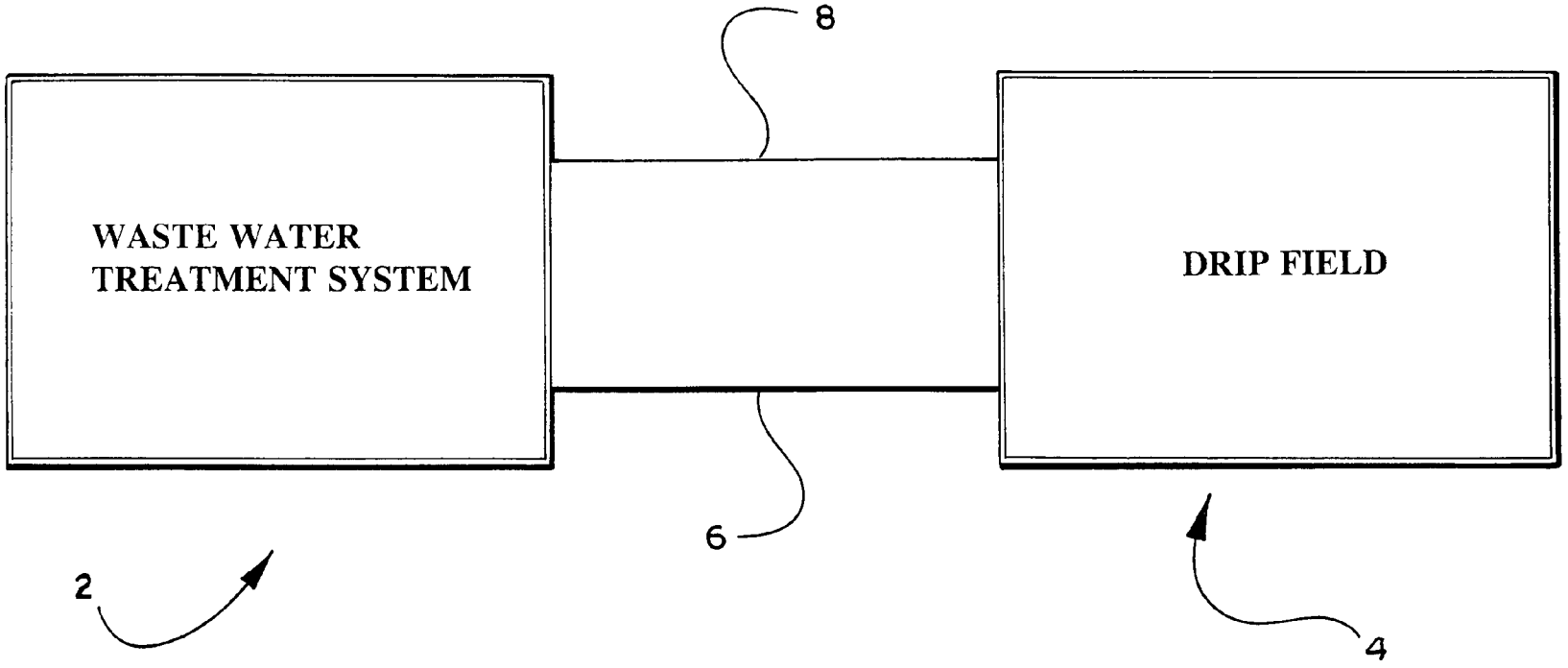
FIG. 1 is a flow schematic showing a waste water treatment system operably connected to a drip field.

The reference numbers in the drawings relate to the following:

2=waste water treatment system
4=drip field
6=discharge conduit
8=flush conduit
10=drip field manifold system
12=upper manifold
14=connector conduit
16=drip line
18=flush manifold
20=extension manifold
22=opening
24=flush plug
26=vacuum breaker
28=check valve
30=coupler
32=loop conduit

DESCRIPTION OF THE PREFERRED EMBODIMENTS

Figure 2:
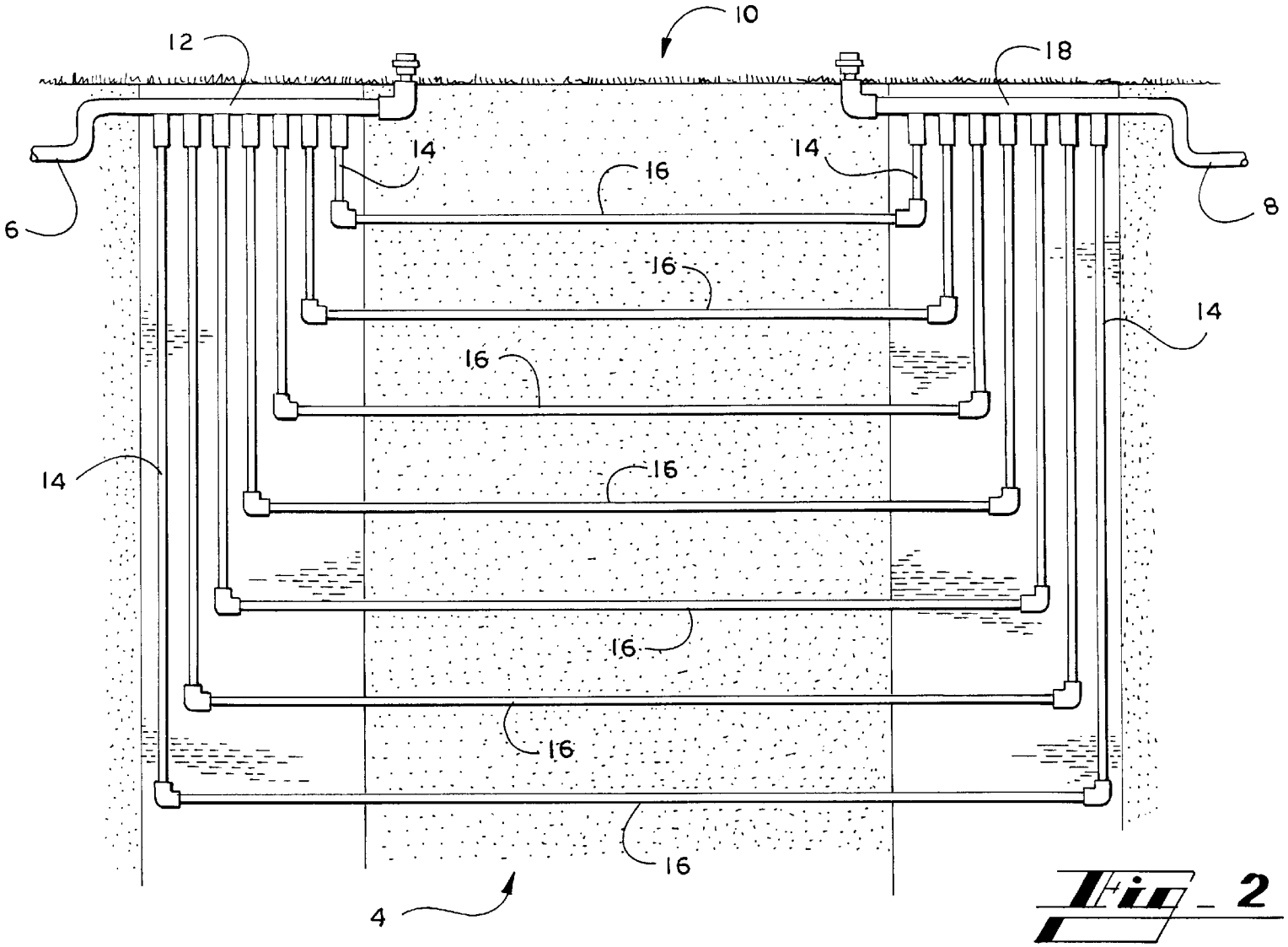
FIG. 2 is one embodiment of a drip field manifold system made in accordance with the present invention.
Figure 3:
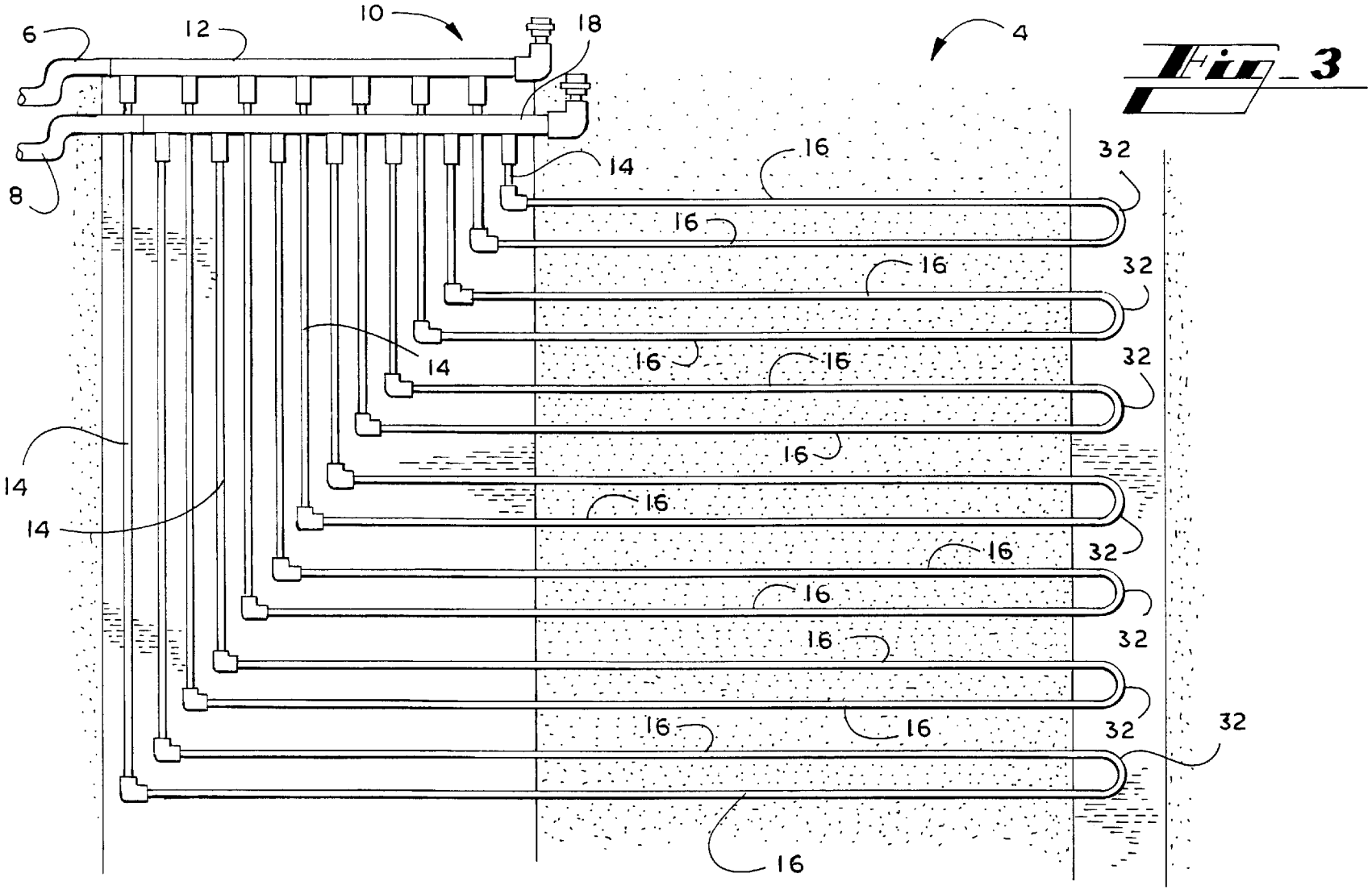
FIG. 3 is another embodiment of the drip field manifold system made in accordance with the present invention.

For a fuller understanding of the nature and desired objects of this invention, reference should be made to the following detailed description taken in connection with the accompanying drawings. Referring to the drawings wherein like reference numerals designate corresponding parts throughout the several figures, reference is made first to FIG. 1. FIG. 1 of the drawings schematically illustrates a waste water treatment system 2 operably connected to a drip field 4. It should be understood that a waste water treatment system 2 and drip field 4 which can readily utilize the present invention are shown in prior U.S. Pat. No. 5,900,065 issued Apr. 6, 1993, which is incorporated herein by reference. Waste water is first treated by the waste water treatment system 2 to produce a treated effluent. The effluent is then delivered from the waste water treatment system 2 to the drip field 4 for disposal by a discharge conduit 6. Referring additionally to FIGS. 2 and 3, FIGS. 2 and 3 illustrate embodiments of a drip field manifold system 10 made in accordance with the present invention. The drip field manifold system 10 comprises an upper manifold 12, a plurality of connector conduits 14, a plurality of drip lines 16 and a flush manifold 18. Each drip line 16 may be characterized by conventional drip line having conventional emitters (not shown) for discharging the treated effluent into the surrounding soil of the drip field 4. When it is desired to flush the drip lines 16 to clear the drip lines 16 and emitters of settled waste solids or other materials, a field flush valve (not shown) is opened to permit rapid movement of effluent through the drip field manifold system 10 from the waste water treatment system 2. The effluent is then returned to the waste water treatment system 2 from the drip field 4 by a flush conduit 8, as shown in FIG. 1.

FIGS. 4, 5 and 6 respectively show the upper manifold 12, the flush manifold 18 and an extension manifold 20. Each of the manifolds 12, 18 and 20 are preferably cylindrically shaped and have threaded ends. Spaced apart openings 22 are provided along the manifolds 12, 18 and 20 to mountingly receive one end of the connector conduits 14.

Referring to FIGS. 2, 3 and 4, the upper manifold 12 is mounted to the discharge conduit 6 at one end and preferably has a flush plug 24 disposed at the other end. The flush plug 24 is provided to enable an operator to have internal access to the upper manifold 12. As an alternative to the flush plug 24, an entry valve (not shown), such as a gate or full open valve, may be utilized. In the preferred embodiment, a vacuum breaker 26 is provided adjacent the upper manifold 12 to prevent the drip field manifold system 10 from retaining a vacuum. Should the drip field manifold system 10 retain a vacuum, previously discharged effluent could be siphoned from the soil of the drip field 4 back into the drip lines 16.

FIGS. 2, 3 and 5 show the flush manifold 18 mounted to the flush conduit 8 at one end and, like the upper manifold 12, having a flush plug 24 disposed at the other end. Although it is not required, a vacuum breaker 26 can be mounted to the flush manifold 18. Further, to prevent effluent back flow into the flush manifold 18 from the flush conduit 8, the flush manifold 18 has a check valve 28 mounted thereto disposed between the flush manifold 18 and the flush conduit 8.

Referring to FIG. 6, the extension manifold 30 has a coupler 30 which is mountable to either the upper or flush manifolds 12 and 18. The extension manifold 30 can be used to extend the upper and flush manifolds 12 and 18 when additional connections for drip lines 16 are needed.

The effluent absorption rate of the soil of the drip field 4 determines the amount of effluent that may be discharged from the drip lines 16. Periodically, it is necessary to cease discharge of effluent to prevent over saturation of the drip field. Generally, this is accomplished by terminating effluent flow from the waste water treatment system 2 to the drip field 4. Unless the drip lines 16 are isolated from one another during the periods of suspended effluent flow, the previously discharged effluent can back flow from the soil through the emitters from the drip lines 16 have higher elevations with respect to the lower most drip line 16 in the drip field 4. Therefore, it is critical for the upper and flush manifolds 12 and 18 to be vertically disposed above the drip line 16 having the highest elevation in the drip field 4. It is also preferable for the upper manifold 12 to be vertically disposed above the discharge conduit, particularly at the junction of the discharge conduit and the upper manifold 12. By having this arrangement, each drip line 16 is isolated from one another during periods of suspended effluent flow from the waste water treatment system 2. Only the limited volume of effluent remaining in the upper and flush manifolds 12 and 18 and the respective connector conduits 14 of the drip lines 16 can continue to discharge after effluent flows from the waste water treatment system 2 is suspended.

Again, referring to FIG. 2, the tipper and flush manifolds 12 and 18 are disposed on either side of the drip field 4. To insure isolation of the individual drip lines 16, the upper and flush manifolds 12 and 18 are installed at the highest elevation of the drip field 4 so that the manifolds 12 and 18 are vertically positioned above the upper most drip line 16 in the drip field 4. Individual connector conduits 14 are mounted to and extend from the respective manifolds 12 and 18 and are connected to respective drip lines 16. Preferably, the drip lines 16 and the upper and flush manifolds 12 and 18 are disposed along the contour of the drip field 4 and are substantially parallel to one another.

Now, referring again to FIG. 3, the upper and flush manifolds 12 and 18 are disposed on the same side of the drip field 4 substantially adjacent and parallel to each other. In this embodiment, the drip lines 16 have a loop conduit 32 connecting pairs of drip lines 16. It is preferable for the drip lines 16 to be substantially parallel to the manifolds 12 and 18. By utilizing the configuration of this embodiment, the number of connector conduits 14 needed is one-half the number of connector conduits 14 of the embodiment of FIG. 2 for the same number of drip lines 16, further reducing the volume of effluent remaining in the drip field manifold system 10 after flow from the waste water treatment system is suspended.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. It should also be readily apparent that the drip field manifold system 10 may be utilized with any water treatment system which utilizes a drip field 4.

Therefore, the foregoing is considered as illustrative only of the principles of the invention. Further, various modifications may be made of the invention without departing from the scope thereof and it is desired, therefore, that only such limitations shall be placed thereon is are imposed by the prior art and which are set forth in the appended claims.

Various modifications may be made of the invention without departing from the scope thereof and it is desired, therefore, that only such limitations shall be placed thereon as are imposed by the prior art and which are set forth in the appended claims.

What is claimed is:

1. A drip field manifold system for use with a waste water treatment system having a drip field, the drip field manifold system being installed in ground which deviates from a horizontal plane wherein the ground defines a plurality of equal elevation contour lines descending from an upper elevation to a lower elevation with respect to the horizontal plane, the system comprising:

an upper manifold to receive effluent from the waste water treatment system, the upper manifold being installed in the ground on a first upper elevation contour line:

a flush manifold to return effluent to the waste water treatment system, the flush manifold being installed in the ground on the first upper elevation contour line on which the upper manifold is installed; and at least one drip line to discharge effluent into the ground of the drip field, the at least one drip line being operatively connected to and being vertically disposed below the upper and flush manifolds, and wherein the said drip line is installed on an equal elevation contour line at a lower elevation than the contour line on which the upper manifold and the flush manifold are installed.

2. A drip field manifold system as claimed in claim 1, wherein the upper manifold, the flush manifold and the at least one drip line are substantially parallel to one another.

3. A drip field manifold system as claimed in claim 2, wherein the upper manifold is proximate one side of the drip field and the flush manifold is proximate the opposite side of the drip field.

4. A drip field manifold system as claimed in claim 2, wherein the upper and flush manifolds are adjacent one another proximate one side of the drip field and have substantially the same vertical elevation above the at least one drip line.

5. A drip field manifold system as claimed in claim 2, wherein the upper manifold further comprises a flush plug.

6. A drip field manifold system as claimed in claim 2, wherein the flush manifold further comprises a flush plug.

7. A drip field manifold system as claimed in claim 2, wherein the upper manifold further comprises a vacuum breaker.

8. A drip field manifold system as claimed in claim 2, wherein the flush manifold further comprises a vacuum breaker.

9. A drip field manifold system as claimed in claim 2, wherein the flush manifold further comprises a check valve to prevent effluent flowing from the waste water treatment system through the flush manifold.

* * * * *